US009978300B2

(12) United States Patent
Bergquist

(10) Patent No.: US 9,978,300 B2
(45) Date of Patent: May 22, 2018

(54) APPARATUS AND/OR METHOD AND/OR COMPUTER PROGRAM FOR CREATING IMAGES ADAPTED FOR TRANSREFLECTIVE DISPLAYS

(71) Applicant: Nokia Technologies Oy, Espoo (FI)

(72) Inventor: Johan Bergquist, Tokyo (JP)

(73) Assignee: Nokia Technologies Oy, Espoo (FI)

( * ) Notice: Subject to any disclaimer, the term of this patent is extended or adjusted under 35 U.S.C. 154(b) by 0 days. days.

(21) Appl. No.: 15/109,484

(22) PCT Filed: Dec. 22, 2014

(86) PCT No.: PCT/FI2014/051035
§ 371 (c)(1),
(2) Date: Jul. 1, 2016

(87) PCT Pub. No.: WO2015/104449
PCT Pub. Date: Jul. 16, 2015

(65) Prior Publication Data

US 2016/0335938 A1 Nov. 17, 2016

(30) Foreign Application Priority Data

Jan. 7, 2014 (GB) ..... 1400196.0

(51) Int. Cl.

| | |
|---|---|
| ***G09G 3/20*** | (2006.01) |
| ***G09G 3/34*** | (2006.01) |
| ***G09G 5/02*** | (2006.01) |
| ***G09G 3/3208*** | (2016.01) |

(52) U.S. Cl.
CPC ..... *G09G 3/2003* (2013.01); *G09G 3/3208* (2013.01); *G09G 3/34* (2013.01); *G09G 5/02* (2013.01); *G09G 2300/0456* (2013.01); *G09G 2310/0235* (2013.01); *G09G 2320/0238* (2013.01); *G09G 2320/0242* (2013.01); *G09G 2320/0295* (2013.01); *G09G 2320/0613* (2013.01); *G09G 2320/0673* (2013.01); *G09G 2360/144* (2013.01); *G09G 2360/16* (2013.01)

(58) Field of Classification Search
CPC ..... G09G 5/02; G09G 3/2003; G09G 2300/0456; G09G 2320/0673
See application file for complete search history.

(56) References Cited

U.S. PATENT DOCUMENTS

| | | | | |
|---|---|---|---|---|
| 8,284,122 | B2 * | 10/2012 | Hagino | G09G 3/2011 345/55 |
| 2007/0242198 | A1 | 10/2007 | Watson et al. | 349/114 |
| 2008/0123000 | A1 | 5/2008 | Lin et al. | 349/33 |
| 2009/0267876 | A1 | 10/2009 | Kerofsky | 345/87 |
| 2011/0175941 | A1 | 7/2011 | Miyake et al. | 345/690 |
| 2013/0021230 | A1 | 1/2013 | Bergquist | 345/90 |

FOREIGN PATENT DOCUMENTS

| | | |
|---|---|---|
| JP | 2011-24031 | 2/2011 |
| JP | 2012-114869 | 6/2012 |

* cited by examiner

*Primary Examiner* — Antonio A Caschera
(74) *Attorney, Agent, or Firm* — Harrington & Smith

(57) ABSTRACT

A method including analysing an image intended for display on a transflective display to identify first pixels and second pixels in the image; and creating an adapted image for display on the transflective display by changing relative reflectance of the first pixels relative to the second pixels.

18 Claims, 4 Drawing Sheets

APPARATUS AND/OR METHOD AND/OR COMPUTER PROGRAM FOR CREATING IMAGES ADAPTED FOR TRANSREFLECTIVE DISPLAYS

TECHNOLOGICAL FIELD

Embodiments of the present invention relate to an apparatus, a method or a computer program for creating an adapted image for display on a transflective display.

BACKGROUND

A transflective display has a reflective mode of operation and a transmissive mode of operation. In the reflective mode the source of illumination for the display is ambient light which is reflected by a reflector. In the transmissive mode, the source of illumination for the display is a back light. A back light may comprise a light source and a light guide, alternatively a distributed light source such as an organic light emitting diode or a thin-film electroluminescent film.

BRIEF SUMMARY

According to various but not necessarily all embodiments of the invention there is provided a method comprising: analysing an image intended for display on a transflective display to identify first pixels and second pixels in the image; and creating an adapted image for display on the transflective display by changing reflectance of the first pixels relative to the second pixels.

According to various but not necessarily all embodiments of the invention there is provided an apparatus comprising: at least one processor; and at least one memory including computer program code the at least one memory and the computer program code configured to, with the at least one processor, cause the apparatus to at least perform:

analysing an image intended for display on a transflective display to identify first pixels and second pixels in the image; and creating an adapted image for display on the transflective display by changing reflectance of the first pixels relative to the second pixels.

According to various but not necessarily all embodiments of the invention there is provided an apparatus comprising: analysis circuitry configured to analyse an image intended for display on a transflective display to identify first pixels and second pixels in the image; and adaptation circuitry configured to create an adapted image for display on the transflective display by changing reflectance of the first pixels relative to the second pixels.

BRIEF DESCRIPTION

For a better understanding of various examples that are useful for understanding the brief description, reference will now be made by way of example only to the accompanying drawings in which.

Figure 7:
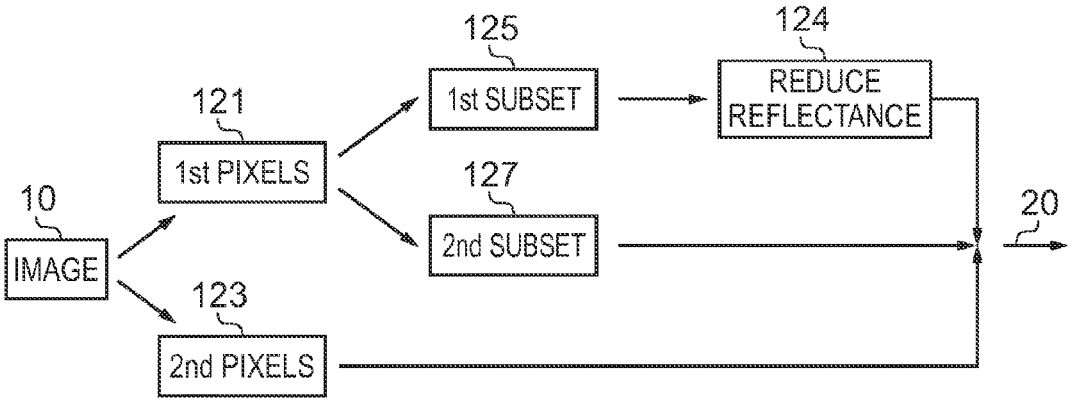
Figure 8:
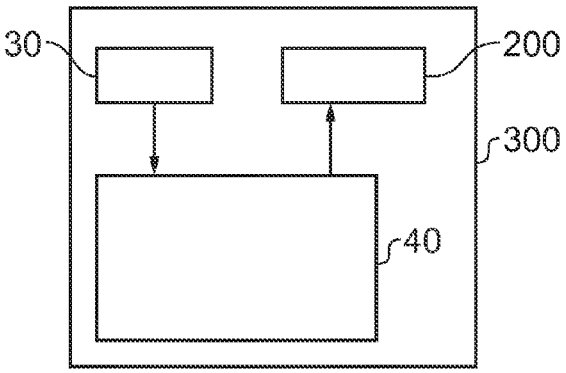
Figure 9:
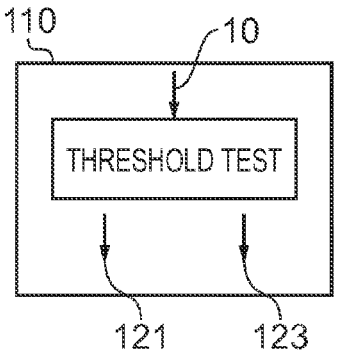
Figure 10A:
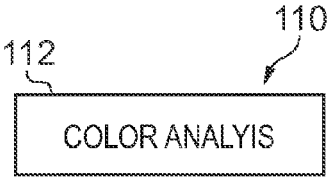
Figure 10B:
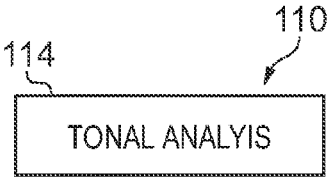
Figure 11A:
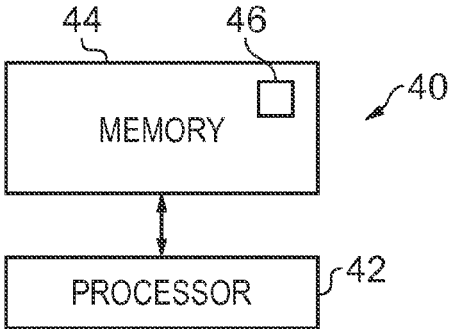

FIG. 7 schematically illustrates a division of an image into different subsets of pixels, the adaptation of at least one of the subsets of first pixels, and the recombination of the subsets to form an adapted image. FIG. 8 illustrates an example of an apparatus comprising a controller;

FIG. 9 illustrates an example of analysis of an image;

FIG. 10A illustrates a further example of analysis of an image;

FIG. 10B illustrates a further example of analysis of an image;

FIG. 11A illustrates a controller comprising a processor and memory; and

Figure 11B:
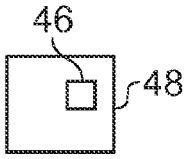

FIG. 11B illustrates a delivery mechanism for a computer program.

DETAILED DESCRIPTION

There are a number of technical problems associated with transflective displays. For example, in the reflective mode ambient light is used as the illumination source which may cause flare (or color desaturation) of the image shown in the transmissive mode. Another problem that arises is that the light path for the illuminating light in the reflective mode travels through the display to a reflector and then through the display again before exiting the display, whereas in the transmissive mode, the light from the illumination source only travels once through the display. As a result, the tone rendering curves will be different in the two cases, i.e. gamma of reflective mode may be twice (×2) that of the transmissive mode for a half-mirror type of transflective display. A split-pixel arrangement with ½ the gap in the reflective mode will solve the gamma problem but the structure is complex and expensive, and the flare problem remains. A problem in transflective displays with black field insertion is that the average reflectance is reduced and text readability is compromised.

The following paragraphs describe a method, apparatus and computer program that addresses at least some of these problems. An image to be displayed is adapted to create a new adapted image, that, when displayed by the transflective display, has improved properties. It may for example simultaneously have good readability of text and color fidelity in bright ambient light.

Figure 1:
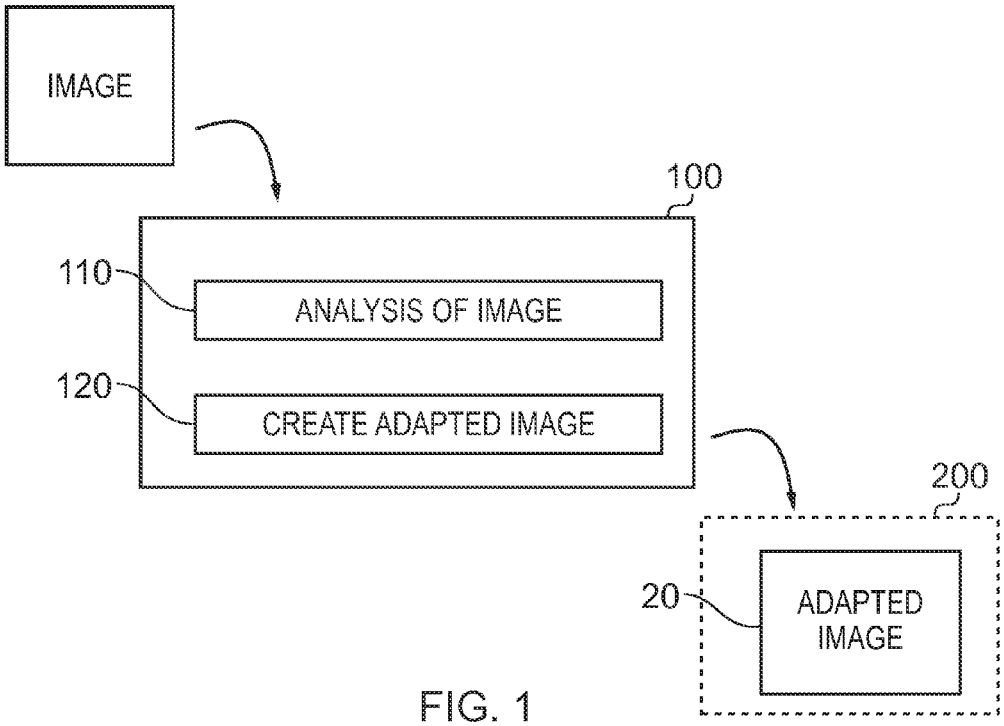
FIG. 1 illustrates an example of a method for creating an adapted image for display on a transflective display.

FIG. 1 illustrates an example of the method 100. In this method 100, at analysis block 110, an image 10 intended for display on a transflective display 200 is analysed to identify first pixels and second pixels in the image. Next, at image creation block 120, the image 10 intended for display on the transflective display 200 is adapted to create an adapted image 20 for display on the transflective display 200. The adapted image 20 is created by changing reflectance of the first pixels of the image 10 relative to the second pixels of the image 10.

According to the method 100, the adapted image 20 may be stored, communicated to another device, or used to control the transflective display 200 to display the adapted image 20, as illustrated in FIG. 1.

Figure 2:
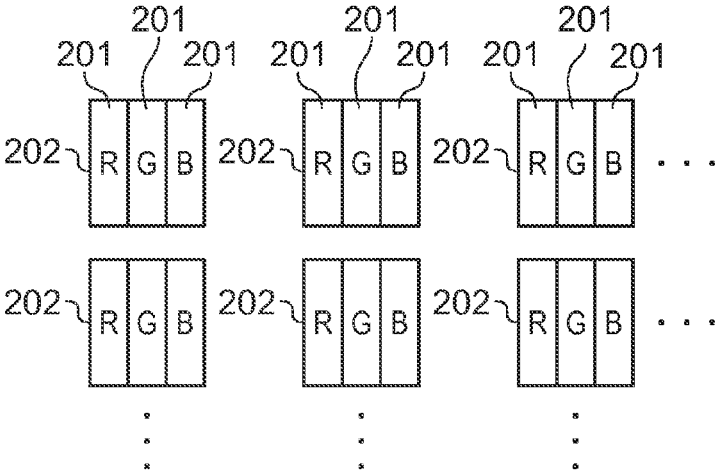
FIG. 2 illustrates an example of pixels.

FIG. 2 illustrates some examples of pixels 202. The pixels 202 are physical picture elements that can have a variable color and which are controlled individually to control an image displayed by the transflective display 200. In this example, the transflective display 200 operates in the red, green, blue color space (RGB). Each pixel 202 comprises a group of sub-pixels 201. Each pixel comprises a red color sub-pixel, a green color sub-pixel and a blue color sub-pixel. However, other arrangements of pixels 202 with different sub-pixels having different primary colors and/or white are possible. The array of pixels may contain separate reflective pixels, which may be monochromatic or divided into primary colors.

Figure 3A:
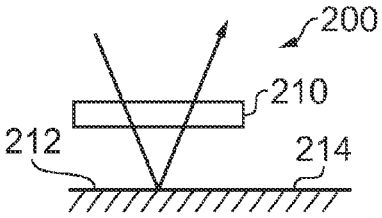
FIGS. 3A and 3B illustrate the operation of a transflective display in the reflective mode and the transmissive mode respectively.
Figure 3B:
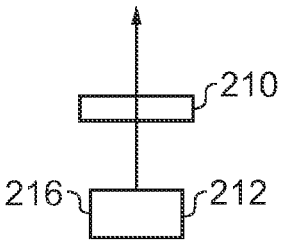

FIGS. 3A and 3B illustrate the operation of a transflective display 200 in the reflective mode (FIG. 3A) and the transmissive mode (FIG. 3B). In both modes, an illumination source 212 outputs light via a control element 210. The control element 210 may, for example, control intensity of the light and/or polarisation of the light and/or color of the light or any combination of one or more of these.

Referring to FIG. 3A, in the reflective mode, the illumination source 212 is a reflector 214 that reflects ambient light through the control element 210. Referring to FIG. 3B, in the transmissive mode, the illumination source 212 is a light emitter 216 which may, for example, be a light guide with light emitting diodes, or a sheet illuminator such as an organic LED or thin-film electro-luminescent (EL) device.

The control element 210 represents a pixel 202. In the reflective mode, the control element 210 represents a reflective pixel and in the transmissive mode the control element 210 represents a transmissive pixel. In a half-mirror type transflective display, the pixel represents both transmissive and reflective pixels.

In some, but not necessarily all examples, the creation of an adapted image 20 comprises spatial modulation of the reflective pixels (but not the transmissive pixels where they are physically distinct). That is the reflective pixels are selectively modulated such that the modulation applied to the reflective pixels varies over the surface of the transflective display 200. The first pixels will typically be reflective pixels, and the second pixels will typically comprise some reflective pixels and all the transmissive pixels (where they are physically distinct).

Changing reflectance of the first pixels, typically involves changing ambient light reflection from some but not all of the reflective pixels. This change may, for example, involve selectively changing pixel grey levels of the image by selectively changing the grey levels of the image itself and/or inserting spatially modulated black frames between images.

Figure 4A:
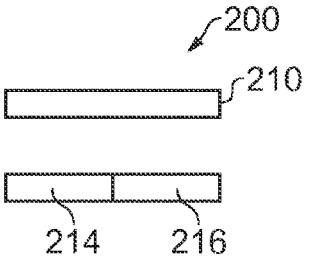
FIGS. 4A and 4B illustrate examples of a cell of a transflective display in which the reflective pixels and transmissive pixels are physically distinct.
Figure 4B:
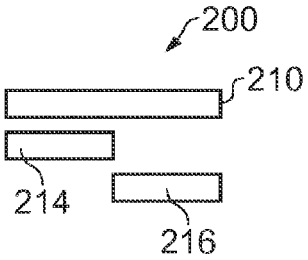
Figure 4C:
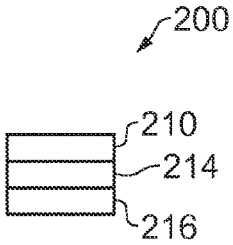
FIG. 4C illustrates an example of a cell of a transflective display in which the reflective pixel and transmissive pixel are combined.

FIGS. 4A, 4B, and 4C illustrate that the transflective display 200 may operate in a split-pixel mode with areas in the reflective mode and transmissive mode (FIGS. 4A, 4B), or may operate simultaneously in the reflective mode and the transmissive mode utilising a partially transparent reflector (FIG. 4C). Furthermore, the split-pixel mode may be split-level. It may, for example, have a gap for the reflective mode that is a fraction of the gap for the transmissive mode in order to ensure the same gamma in transmissive mode and reflective mode (FIG. 4B).

FIGS. 4A and 4B illustrate examples of a cell of a transflective display 200 in which the reflective pixel and transmissive pixel are physically distinct and laterally separated. The transflective display 200 is formed from an array of such cells. Each of the illumination sources 214, 216 may be associated with a different control element 210 or may share a control element 210. As a consequence of the lateral separation of the illumination sources 214, 216, the reflective pixel and the transmissive pixel are also laterally separated. In FIG. 4A, the illumination sources 214, 216 are at the same height and are arranged side-by-side. In FIG. 4B, the illumination sources 214, 216 are at different heights (split-level).

FIG. 4C illustrates an example of a cell of a transflective display 200 in which the reflective pixel and transmissive pixel are combined by means of a partially transmitting reflector. The transflective display 200 is formed from an array of such cells. In this example, the illumination source 216 for the transmissive mode underlies the illumination source 214 for the reflective mode. The reflector 214 for the reflective mode may, for example, be a half mirror or other form of transflector. A common control element 210 is shared by both the reflective mode and the transmissive mode.

Figure 5:
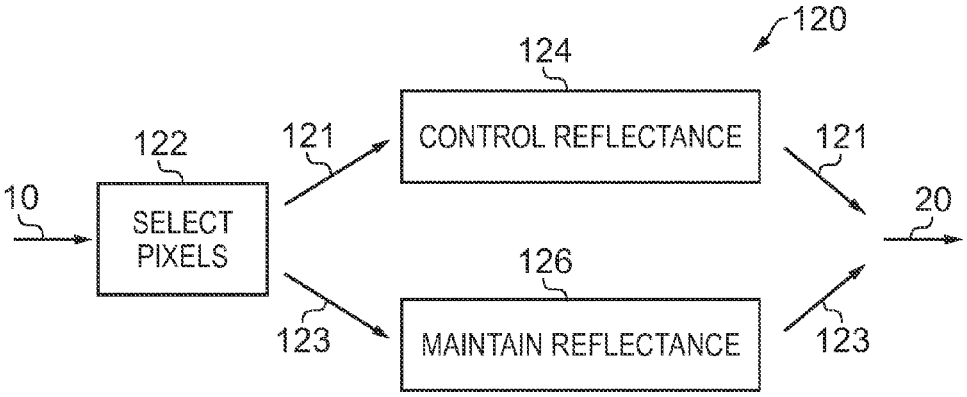
FIG. 5 illustrates an example of creating an adapted image.

FIG. 5 illustrates an example of how the image creation block 120 in FIG. 1 may be performed. In this example, at image creation block 120, an adapted image 20 is created from the original image 10 by performing spatial-dependent modulation in relation to the original image 10. The image 10 is 'original' in that it is an image that exists prior to adaptation. It may or may not be the same as an image as captured.

An adapted image 20 may be created by spatial modulation of the original image 10 itself. An adapted image 20 may be created, alternatively or additionally, by inserting spatially modulated black frames sequentially between the image frames or image fields in the case of field-sequential color displays. Under certain illumination and/or thermal conditions, only temporal black frame/field modulation may be present. The black frame insertion creates an adapted image 20 because the user perceives a different image compared to the original image 10 because human vision integrates over space and time.

At block 122, the original image 10 is divided into first pixels 121 and second pixels 123. At image adaptation block 124, the reflectance of the first pixels 121 is controlled, whereas at block 126, the reflectance of the second pixels 123 is maintained.

The first pixels may represent the reflective pixels which would otherwise have caused flare and color desaturation of the second pixels. The control of reflectance may reduce reflectance. The grey level of an image may be controlled by adapting the image by either spatially modulating the image itself, spatially modulating an inserted black field, or spatially modulating the reflective sub pixels of the image.

The reduction of grey level which occurs at image adaptation block 124 occurs on a pixel by pixel basis. The grey level of individual pixels is separately and independently controlled. This control is used to introduce a spatially dependent variation in reflectance of the first pixels 121.

The effect of the image adaptation block 124 is to effect a reduction in the reflectance of some of the pixels associated with the reflective mode of the transflective display 200. It is particularly useful for enhancing the color and/or tone by reducing the impact of the reflective mode in the transmissive mode and is advantageously applied to images particularly where there are areas of color shade or color shaded graphics.

The adapted first pixels 121 and the second pixels 123 are combined as the adapted image 20.

The reflectance may be maintained by block 126 for the second pixels 123 which may correspond to very colorful areas of the image and/or areas of pure tone/high contrast such as text.

Figure 6:
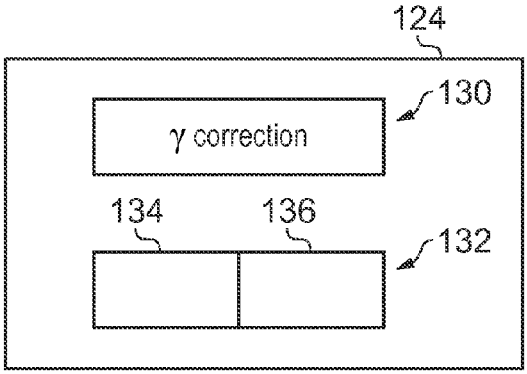
FIG. 6 illustrates an example of reflectance reduction.

FIG. 6 illustrates an example of the image adaptation block 124 in more detail.

The image adaptation block may comprise a γ correction at block 130 and/or a black frame insertion block 132.

In this example, the tone rendering curve of the first pixels 121 may be adjusted by performing a γ correction at block 130. The correction may depend upon the design of the transflective display 200. The value of the γ correction may be designed to mitigate the effect of a longer path length through the transflective display 200 in the reflective mode compared to the transmissive mode. As a result, more grey shades are resolved in ambient light.

The reduction in reflectance of the first pixels 121 may occur, at block 132, using a binary map to set the first pixels to a black color temporarily, thereby reducing reflectance. The binary map of pixels for the image 20 identifies the first pixels 121 with a first binary value that identifies the second pixels 123 with a second binary value. The black frame insertion block 132 applies a filter to those first pixels with the first binary value so that they are set to black.

The binary map causes the insertion of a spatially modulated black frame between each image frame or image field in a field sequential colour display. This improves color performance in the outdoors for field-sequential color displays, without compromising on brightness in parts of the image that do not contain any color.

The binary map may be used to set only those pixels related to the reflective mode to black. In the example, where the transflective display is a display similar to that illustrated in FIG. 4A or 4B, the binary map is used to control the reflective pixels, which are physically separated from the transmissive pixels. The binary map can therefore provide, at block 134, spatially dependent modulation to the reflective pixels.

In the example of FIG. 4C, the reflective pixels and transmissive pixels are not separated in space. The binary map is therefore used, at block 136, to provide spatially-dependent modulation of the pixels of the transflective display periodically. The binary map may be used for spatially modulated black field insertion (BFI).

FIG. 7 schematically illustrates a division of the image 10 into different subsets, the adaption of pixels in a selected sub-set(s) and the recombination of the subsets to form the adapted image 20. Initially the original image 10 is divided into first pixels 121 and second pixels 123. In some embodiments, the first pixels 121 may additionally be divided into a subset 125 and a second subset 127. The image 10 is 'original' in that it is an image that exists prior to the processing illustrated in FIG. 7 used to form the adapted image 20. It may or may not be the same as an image as captured.

The second pixels 123 will include those pixels that do not require a change of reflectance or transmittance, for example, because they have a high color saturation value, or a pure tone.

The first pixels 121 may relate to pixels that are less colorful and/or have mid tone values.

Different γ corrections are applied to the first subset 125 of first pixels 121 and the second subset 127 of first pixels 121.

In this example, a γ correction is applied to the first subset 125 of first pixels 121 but no γ correction is applied to the second subset 127 of first pixels 121 because the application of the γ correction to the second subset 127 of first pixels 121 would result in oversaturation or clipping of the second subset of first pixels. The correction is also not applied to the second pixels 123.

The division of the pixels into the first pixels 121 and the second pixels 123 is dependent upon image analysis and, for example, the identification of pixels that would benefit from a reduction in ambient light reflection. This will be described in further detail in relation to FIGS. 9, 10A and 10B.

The division of the first pixels 121 into the first subset 125 and the second subset 127 may be dependent upon a measurement of ambient light, dependent upon a reflectance of the transflective display 200 in the reflective mode, and dependent upon the value of the γ correction.

FIG. 8 illustrates an example of an apparatus 300 comprising a controller 40 which may be configured to separate the first pixels 121 into the first subset 125 and the second subset 127. It is also configured to control the transflective display 200.

In this example, the controller 40 receives a measurement of ambient light from an ambient light detector 30.

The controller 40 determines a threshold value based upon, for example, the multiplication of the reflectance of the transflective display 300 with a value representing the detected ambient light by the ambient light detector 30 and a scaling constant.

The grey level values of the first pixels 121 after they have been γ corrected, may be compared against this threshold. Those first pixels 121 that post-gamma correction do not exceed the threshold are assigned to the first subset 125 and those first pixels 121 that post-gamma correction do exceed the threshold are assigned to the second subset 127.

FIG. 9 illustrates an example of the analysis block 110 in FIG. 1. The purpose of this block is to analyse the image 10 intended for display on the transflective display 200 to identify first pixels 121 and second pixels 123.

In some but not necessarily all examples, the analysis requires a pixel-by-pixel analysis of the image 10 against a threshold or thresholds. If a pixel passes the threshold test then it is determined to be a first pixel 121 and if the pixel fails the threshold test it is determined to be a second pixel 123. The result of this analysis block 110 may be in the form of a binary map for use in black frame insertion block 132 of FIG. 6.

FIG. 10A illustrates an example of an analysis block 110, in which the threshold test involves color analysis. In this example, the chroma of a pixel is compared against a threshold value. If the pixel has a large chroma, above the threshold chroma, it is determined to be a first pixel 121 for which the corresponding reflective sub pixel is subject to reflectance reduction (black area insertion) If, however, the pixel is determined to have a chroma less than the threshold chroma, it is determined to be a pixel that may not require reflectance adjustment of the corresponding sub pixel and is selected as a second pixel 123.

The reflectance contribution from the reflective sub pixels of pixels with high chroma will be reduced, and hence flare or desaturation of the transmissive image will also be reduced. For low-chroma image content such as text or monochrome photos or graphics, high reflectance is more important and hence the reflectance reduction is not applied for such content.

FIG. 10B illustrates an example of an analysis block 110 in which the threshold test is based upon tonal analysis 114.

The tone of the image 10 may be represented as a histogram that records the cumulative occurrence of each grey tone in the image. An average grey tone value may be found for the image and a variance used on either side of that average value to define a midrange for the histogram. This midrange represents those pixels with mid-tone values. These pixels, with mid-tone values, may be designated as first pixels 121 and the remaining pixels may be designated as second pixels 123. The result of this analysis block 110 may be used in γ correction block 130 of FIG. 6, as part of image adaptation block 124 in either FIG. 5 or 7.

Any of the preceding methods, described in relation to any of the Figs, and any of the blocks may be performed by a controller, such as the controller 40 illustrated in FIG. 8.

The controller 40 may be configured to select whether the image adaptation block 124 uses γ correction block 130 and/or black frame insertion block 132. It may also be configured to determine whether to use block 134 or block 136 of black frame insertion block 132.

For example, if the first pixels 121 are color pixels then, in some examples, both γ correction block 130 and block 132 may be performed. For example, if the first pixels 121 are achromatic (monochromatic) then, in some examples, only block 132 may be performed.

For example, if the transflective display 200 has laterally distinct reflective and transflective pixels (e.g. as illustrated in FIGS. 4A and 4B), then the controller 40 may be configured to control the image adaptation block 124 to use γ correction block 130. The value of the γ correction may depend upon the type of transflective display and the tone rendering curves, which may depend upon the difference of the path length for light through the display for the reflective mode and the transmissive mode.

Implementation of the controller 40 can be in hardware alone (a circuit, a processor), have certain aspects in software including firmware alone or can be a combination of hardware and software (including firmware).

For example, the analysis block 110 may be performed by analysis circuitry and the image creation block 120 may be performed by circuitry that comprises adaptation circuitry configured to perform that image adaptation block 124.

The controller 40 may be implemented, as illustrated in FIG. 11A, using instructions that enable hardware functionality, for example, by using executable computer program instructions 46 in a general-purpose or special-purpose processor 42 that may be stored on a computer readable storage medium (disk, memory etc) to be executed by such a processor 42.

The processor 42 is configured to read from and write to the memory 44. The processor 42 may also comprise an output interface via which data and/or commands are output by the processor 42 and an input interface via which data and/or commands are input to the processor 42.

The memory 44 stores a computer program 46 comprising computer program instructions (computer program code) that controls the operation of the apparatus 300 when loaded into the processor 42. The computer program instructions, of the computer program 46, provide the logic and routines that enables the apparatus to perform the methods illustrated in FIGS. 1, 5 to 9, 10A and 10B. The processor 42 by reading the memory 44 is able to load and execute the computer program 46.

The controller 40 therefore comprises:

at least one processor 42; and at least one memory 44 including computer program code 46 the at least one memory 44 and the computer program code 46 configured to, with the at least one processor 42, cause the controller 40 at least to perform:

analysing an image 10 intended for display on a transflective display 200 to identify first pixels 121 and second pixels 122 in the image 10; and creating an adapted image 20 for display on the transflective display 200 by changing relative reflectance of the first pixels 121 relative to the second pixels 122.

The computer program 46 may arrive at the controller 40 via any suitable delivery mechanism 48. The delivery mechanism 48 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 46. The delivery mechanism may be a signal configured to reliably transfer the computer program 46. The apparatus 300 may propagate or transmit the computer program 46 as a computer data signal.

Although the memory 44 is illustrated as a single component it may be implemented as one or more separate components some or all of which may be integrated/removable and/or may provide permanent/semi-permanent/dynamic/cached storage.

Although the processor 42 is illustrated as a single component it may be implemented as one or more separate components some or all of which may be integrated/removable.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks illustrated in the FIGS. 1 and 5-9 and 10A and 10B may represent steps in a method and/or sections of code in the computer program 46. The illustration of a particular order to the blocks does not necessarily imply that there is a required or preferred order for the blocks and the order and arrangement of the block may be varied. Furthermore, it may be possible for some blocks to be omitted.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A method comprising:

analysing an image intended for display on a transflective display to identify first pixels and second pixels in the image, said first pixels being reflective pixels in the transflective display, and the transflective display having a transmission mode and a reflection mode;

creating an adapted image for display on the transflective display by changing reflectance of the first pixels relative to the second pixels by temporarily setting a color of the first pixels to black, and through spatial modulation of reflective pixels, but not of transmissive pixels, wherein reflective pixels are operational during the reflective mode and transmissive pixels are operational during the transmissive mode; and performing at least one of:

storing the adapted image;

forwarding the adapted image to a device; and using the adapted image to control the transflective display.

2. The method as claimed in claim 1, further comprising: controlling the transflective display to display the adapted image.

3. The method as claimed in claim I, wherein creating the adapted image comprises reducing reflectance of the first pixels.

4. The method as claimed in claim 1, wherein creating the adapted image comprises reducing reflectance of pixels associated with the reflection mode of the transflective display.

5. The method as claimed in claim 1, wherein creating the adapted image comprises maintaining reflectance or transmittance of the second pixels.

6. The method as claimed in claim 1, wherein creating the adapted image comprises independently controlling reflective pixels and transmissive pixels.

7. The method as claimed in claim 1, further comprising: controlling the transflective display having physically distinct reflective pixels and transmissive pixels to display the adapted image.

8. The method as claimed in claim 1, further comprising: controlling the transflective display in which the reflective pixels and transmissive pixels are combined via a transflector.

9. The method as claimed in claim 1, wherein creating the adapted image comprises performing gamma correction on at least some of the first pixels.

10. The method as claimed in claim 9, wherein the gamma correction is dependent upon a design of the transflective display.

11. The method as claimed in claim 9, wherein the gamma correction is selective and is applied to a first sub-set of the first pixels but not to a second sub-set of the first pixels.

12. The method as claimed in claim 11, wherein the second sub-set of the first pixels are selected to avoid clipping of the second sub-set of the first pixels as a consequence of gamma correction.

13. The method as claimed in claim 11, wherein the selection is dependent upon detected ambient light at the transflective display.

14. The method as claimed in claim 1, further comprising: performing gamma correction on at least some of the first pixels.

15. The method as claimed in claim 1, wherein the creation of the adapted image is dependent upon whether the adapted image is monochrome or colored.

16. The method as claimed in claim 1, wherein analysing the image comprises a pixel-by-pixel analysis of the image against a threshold.

17. An apparatus comprising:

at least one processor; and at least one memory including computer program code; the at least one memory and the computer program code configured, with the at least one processor, to cause the apparatus at least to perform:

analyse an image intended for display on a transflective display to identify first pixels and second pixels in the image, said first pixels being reflective pixels in the transflective display, and the transflective display having a transmission mode and a reflection mode;

create an adapted image for display on the transflective display by changing reflectance of the first pixels relative to the second pixels by temporarily setting a color of the first pixels to black, and through spatial modulation of reflective pixels, but not of transmissive pixels, wherein reflective pixels are operational during the reflective mode and transmissive pixels are operational during the transmissive mode; and perform at least one of:

store the adapted image;

forward the adapted image to a device; and use the adapted image to control the transflective display.

18. The apparatus as claimed in claim 17, further comprising: the transflective display.

* * * * *